US007020988B1

(12) United States Patent
Holden et al.

(10) Patent No.: US 7,020,988 B1
(45) Date of Patent: Apr. 4, 2006

(54) FOOTWEAR WITH ENHANCED IMPACT PROTECTION

(75) Inventors: Lenny M. Holden, Lake Forrest, CA (US); William R. Peterson, Palm Desert, CA (US); David D. Chase, Albuquerque, NM (US); Edward C. Frederick, Exeter, NH (US)

(73) Assignee: Pierre Andre Senizergues, Newport Beach, CA (US)

( * ) Notice: Subject to any disclaimer, the term of this patent is extended or adjusted under 35 U.S.C. 154(b) by 110 days.

(21) Appl. No.: 10/652,456

(22) Filed: Aug. 29, 2003

(51) Int. Cl.
*A43B 13/20* (2006.01)
*A43B 21/32* (2006.01)

(52) U.S. Cl. ..... 36/35 B; 36/29; 36/141; 36/37

(58) Field of Classification Search ..... 36/28, 36/29, 35 R, 35 B, 3 B, 30 R, 31, 25 R, 36/34 R
See application file for complete search history.

(56) References Cited

U.S. PATENT DOCUMENTS 4,183,156 A 1/1980 Rudy
4,219,945 A 9/1980 Rudy
4,267,648 A 5/1981 Weisz
4,271,606 A 6/1981 Rudy
4,342,158 A 8/1982 McMahon et al.
4,535,553 A 8/1985 Derderian et al.
4,768,295 A 9/1988 Ito
4,815,221 A * 3/1989 Diaz ..... 36/27
5,092,060 A 3/1992 Frachey et al.
5,369,896 A 12/1994 Frachey et al.
5,493,792 A 2/1996 Bates et al.
5,632,045 A 5/1997 Chase et al.
5,671,552 A 9/1997 Pettibone et al.
5,673,437 A 10/1997 Chase et al.
5,704,137 A 1/1998 Dean et al.
5,718,063 A 2/1998 Yamashita et al.
5,815,950 A * 10/1998 Wang ..... 36/29
5,881,478 A * 3/1999 McMahon et al. ..... 36/144
5,918,383 A 7/1999 Chee
5,933,983 A * 8/1999 Jeon ..... 36/29
6,176,025 B1 * 1/2001 Patterson et al. ..... 36/28
6,199,302 B1 3/2001 Kayano
6,212,795 B1 4/2001 Nakabe et al.
6,374,514 B1 * 4/2002 Swigart ..... 36/35 B
6,665,958 B1 * 12/2003 Goodwin ..... 36/29

* cited by examiner

*Primary Examiner*—Jila M. Mohandesi
(74) *Attorney, Agent, or Firm*—Don C. Lawrence; MacPherson Kwok Chen & Heid LLP

(57) ABSTRACT

Footwear providing enhanced protection against extreme landing impacts includes a sole having an elastomeric mid-sole with elastomeric pads combined in a heel recess thereof such that the pads act in series with each other and in parallel with the mid-sole during conjoint compression thereof. At least one of the pads includes a solid gel having a relatively high damping coefficient. In another embodiment, the heel of the mid-sole is replaced by a toroidal gas cushion and an elastomeric pad including a solid gel having a relatively high damping coefficient disposed in a central recess of the cushion such that the pad is recessed a selected distance below the upper surface of the cushion. The resilient pads may advantageously incorporate a plurality of gas-filled cells, and a solid gel pad may also be disposed in the mid-sole of the footwear below the ball of the wearer's foot for increased protection.

18 Claims, 7 Drawing Sheets

FOOTWEAR WITH ENHANCED IMPACT PROTECTION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO APPENDIX

Not Applicable

BACKGROUND OF THE INVENTION

1. Field of the Invention

This invention relates to footwear in general, and in particular, to footwear affording enhanced protection against extreme landing impacts acting on the feet of a wearer during certain strenuous athletic activities, such as skateboarding and snowboarding.

2. Description of Related Art

An important function of footwear, particularly athletic shoes, is to protect the wearer's feet against injury caused by forceful contact with the ground or other supporting surfaces. Accordingly, modern athletic footwear typically incorporate some form of a resilient sole disposed below the wearer's foot that serves to attenuate the shock and impact forces imparted to the wearer's feet by the contact surface during running and jumping. This impact attenuation function is typically achieved by the incorporation of resilient, i.e., spring-like, elements within the sole of the shoe, and typically within the mid-sole portion thereof.

These resilient elements typically take the form of a layer of an elastomer, e.g., ethylene vinyl acetate ("EVA"), acting in compression, either alone, or in combination with other forms of springs. Examples of footwear with soles incorporating elastomeric layers acting in combination with various other forms of mechanical springs may be found in, e.g., U.S. Pat. No. 6,212,795 to Nakabe et al.; U.S. Pat. No. 5,918,383 to Chee; U.S. Pat. No. 5,671,552 to Pettibone et al.; U.S. Pat. No. 4,535,553 to Derderian et al.; U.S. Pat. No. 4,342,158 to McMahon et al.; and, U.S. Pat. No. 4,267,648 to Weisz.

Alternatively, the resilient sole elements may incorporate gas-filled springs, such as those described in U.S. Pat. Nos. 5,369,896 and 5,092,060 to Frachey et al.; and, 4,271,606 and 4,183,156 to Rudy.

In addition to elements with resiliency, the soles of modern athletic footwear may also incorporate elements having a relatively high damping characteristic, viz., high viscosity liquids referred to as "gels". Examples of footwear incorporating liquid gels in the soles thereof may be found in, e.g., U.S. Pat. No. 6,199,302 to Kayano; U.S. Pat. No. 5,718,063 to Yamashita et al.; U.S. Pat. No. 5,704,137 to Dean et al.; U.S. Pat. No. 5,493,792 to Bates; and, U.S. Pat. No. 4,768,295 to Ito.

Although the conventional footwear described in the above references provide some measure of impact protection to the feet of the wearer during athletic activities involving typical running and jumping, they are incapable of providing effective protection during those activities involving extreme shocks and impacts, such as skateboarding and snowboarding, because of their common tendency to "bottom-out," i.e., to harden rapidly in response to increasingly greater impact forces, such that their ability to store the energy associated with those greater forces is substantially diminished, and a proportionately greater portion of the impact energy is therefore transmitted to the wearer's feet.

A long felt but as yet unsatisfied need therefore exists in the field for footwear that overcomes the bottoming-out problem, and that is capable of protecting the wearer's feet against extreme landing impacts acting thereon during certain strenuous athletic activities.

BRIEF SUMMARY OF THE INVENTION

In accordance with the present invention, footwear is provided that substantially reduces the bottoming-out problem of the sole portion thereof and thereby affords the feet of a wearer with enhanced protection against extreme landing impacts occurring during certain strenuous athletic activities engaged in by the wearer, such as skateboarding, snowboarding, and jumping.

In one exemplary preferred embodiment, the novel footwear comprises a sole portion with an elastomeric mid-sole having a given thickness, durometer, and damping coefficient. A plurality of elastomeric pads, each having a respective thickness, durometer and damping coefficient, are combined in a recess in the mid-sole, preferably centered below the heel of the wearer's foot, such that the pads act in series combination with each other and in parallel combination with the mid-sole during conjoint compression thereof. The combined pads have a thickness and an effective spring rate that are respectively about the same as the thickness and the spring rate of the mid-sole alone, and an effective damping coefficient that is substantially greater than the damping coefficient of the mid-sole alone.

Preferably, at least one of the elastomeric pads comprises a "solid gel" having a relatively moderate durometer and a relatively high damping coefficient, i.e., a durometer on the Shore "00 scale" of not less than about 35, and a Shore resiliometer rebound of not greater than about 35 percent, respectively. The solid gel pad may comprise polyvinyl chloride, polyurethane, synthetic rubber, olefin or silicon rubber, and in one preferred embodiment thereof, may comprise the proprietary shock-absorbing material called "Gelpact."

In another possible embodiment, at least one of the resilient pads incorporates a plurality of gas-filled cells, which may comprise open and/or closed cells. The open cells may comprise one or more tubular recesses formed into the upper and/or the lower surface of the pad to enable the effective spring rate of the pad to be set at the time of its manufacture.

In yet another exemplary preferred embodiment, the resilient mid-sole of the footwear incorporates a gas-filled spring, or cushion, occupying substantially all of the heel portion of the mid-sole. The gas cushion preferably includes toroidal exterior walls, a generally central recess, and respective upper and lower surfaces that are generally flush with respective upper and lower surfaces of the mid-sole. The cushion is preferably filled with air at a pressure of from between about 0–6 psig, or alternatively, at a pressure selected to approximately match the spring rate of the cushion with that of the mid-sole.

An elastomeric pad having a thickness less than that of the gas cushion is disposed in the recess of the cushion such that an upper surface of the pad is recessed a selected distance below the upper surface of the cushion. As in the first embodiment above, the elastomeric pad preferably comprises a solid gel having a Shore 00 scale durometer of not less than about 35, and a Shore resiliometer rebound percentage of not greater than about 35 percent. The pad may also incorporate a plurality of gas-filled cells to adjust its effective hardness or spring rate.

In this embodiment, the gas cushion acts independently of both the mid-sole and the resilient pad for moderate compressive displacements thereof, and for extreme impacts, acts in parallel combination with the pad, so that the effective spring rate of the mid-sole in compression is more linear, and the damping coefficient is substantially greater than those of the mid-sole alone.

In one advantageous variant of either of the above two embodiments, an elastomeric pad may be disposed in the resilient mid-sole of the footwear below the ball of the wearer's foot, and as in the heel portion of the shoe, this pad may comprise a solid gel having a Shore 00 scale durometer of not less than about 35, and a Shore resiliometer rebound percentage of not greater than about 35 percent.

A better understanding of the above and many other features and advantages of the invention may be obtained from a consideration of the detailed description thereof below, particularly if such consideration is made in conjunction with the figures of the appended drawings.

DETAILED DESCRIPTION OF THE INVENTION

Figure 1:
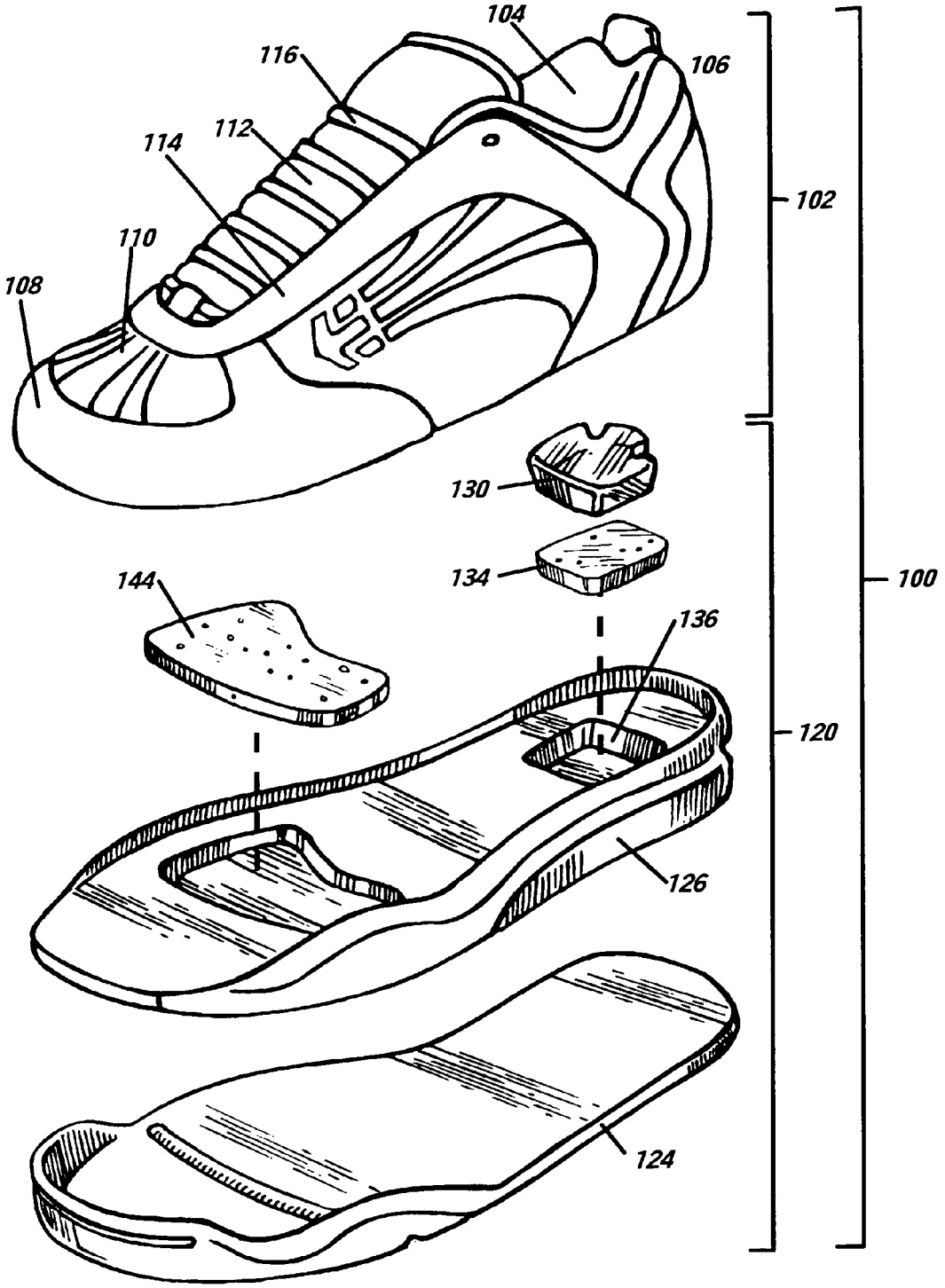
FIG. 1 is an exploded view of footwear providing enhanced protection against extreme landing impacts in accordance with a first exemplary embodiment of the present invention.

A first exemplary embodiment of a shoe 100 providing enhanced protection against extreme landing impacts in accordance with the present invention is illustrated in the exploded view of FIG. 1. The shoe illustrated comprises the left half of a symmetrical pair of footwear of a type that is commonly worn during certain strenuous athletic activities, including running, jumping, skateboarding, snowboarding, and the like.

In the particular exemplary embodiment illustrated in FIG. 1, the shoe 100 comprises a soft, flexible upper portion 102 that conformably surrounds an upper portion of a wearer's foot (not illustrated), and a sole portion 120 that is attached to the upper and thereby held between the wearer's foot and the ground or other contact surface (not illustrated), e.g., the upper surface of a skateboard or snowboard, with which the lower surface of the foot makes forceful contact during athletic activities.

The exemplary upper 102 of the shoe 100 illustrated includes an opening 104 through which the wearer's foot (not illustrated) is inserted into the shoe, a heel counter 106, a toe box 108, a vamp 110, a tongue 112, a pair of flaps 114 disposed on opposite sides of and overlapping the tongue, and a lace 116 extending through eyelets (not seen) in the flaps to secure the shoe on the wearer's foot, in a conventional manner. The upper may incorporate a laminated construction comprising sewn and/or bonded layers of soft, flexible leathers, plastic and/or cloth, and may have an interior surface that is padded for additional comfort.

In the particular exemplary embodiment illustrated, the sides of the upper 102 are disposed below the wearer's ankle, thereby characterizing the shoe 100 as a "low-top" shoe, but in other embodiments, i.e., "high-top" shoes, the sides of the upper can extend up to or above the wearer's ankle, and in the case of a boot, e.g., a snowboarding or a work boot, to cover part or all of the wearer's calf. Thus, it should be understood that the invention, which relates more specifically to the sole 120 portion of the shoe described below, is not limited to footwear having the particular type of upper illustrated, but rather, is applicable to a wide variety of other types of footwear and associated uppers.

As illustrated in FIG. 1, the sole 120 of the exemplary shoe 100 comprises a lamination of a plurality of components, including an insole 122 (see FIGS. 5A–5C), a resilient, flexible outsole 124, and resilient mid-sole 126. The insole may comprise a thin, separate, semi-rigid layer of, e.g., plastic, paper or cork, or in an alternative embodiment, i.e., in a so-called "stroebel," or "California construction" shoe, may comprise a woven, cloth-like sock-liner that is integrally attached to the upper 102 of the shoe. The insole functions to distribute the load imposed by the wearer's foot on the mid-sole and outsole more uniformly over the area of the sole.

The outsole 124 of the shoe 100 illustrated preferably comprises a strong, resilient, wear-resistant elastomer of compression-molded, synthetic rubber, e.g., neoprene or polyurethane. Like the resilient mid-sole 126 described below, the outsole functions to absorb, i.e., store and dissipate, a small portion of the shock and impact forces acting on the wearer's foot during landings, but its primary functions are, 1) to increase the frictional coefficient between the shoe and the ground or other contact surface, thereby affording the wearer's foot with a non-slipping "traction," for which its lower surface 128 may be provided with cleats, lugs, lands and grooves, or the like (not illustrated), and 2)

to resist wear-abrasion of the lower surface of the shoe caused by its frictional engagement with the contact surface.

The primary function of the resilient mid-sole 126 of the sole 112 is, like that of most conventional athletic footwear, to cushion the wearer's foot, particularly the heel, where the forces are concentrated, against the shock and impact forces acting between the foot and the contact surface during landing of the foot. Thus, while it is possible for the ground to exert a sudden, relatively large "shock" force on the foot, as when a skateboard or snowboard encounters a sharp bump or sudden rise in the ground surface, it is much more common, for practical reasons, for the reverse to occur, i.e., for the foot to exert a sudden, relatively large "impact" force on the contact surface, as when the foot of a runner or jumper strikes the ground, or when a skateboard or snowboard on which the user is riding lands after falling a moderate distance, such as from a step or a ramp.

While the forces act on the wearer's foot in the same way in either case, the level of the forces involved in landing impacts are typically much greater, and if not attenuated by either the footwear, the contact surface, and/or the skateboard or snowboard, can result in injury to the foot. To achieve this impact attenuation function, the mid-soles of conventional athletic footwear typically incorporate a layer of an elastomer, e.g., ethylene vinyl acetate ("EVA"), such as Phylon, acting in compression between the foot and the contact surface, either alone, or in combination with other forms of springs, such as mechanical or gas springs, to store and dissipate the kinetic energy associated with landing.

Mid-soles incorporating elastomeric materials are preferred because, for a given durometer, or spring rate, deflection capability, and energy storage and dissipation, elastomers cost and weigh less, require less space in which to function, and are more flexible in terms of their configurability, than other shock and impact absorbing mechanisms. However, they also share a practical drawback common to certain other types of resilient mechanisms, viz., a tendency to harden with increasing deflection. That is, the slope of the curve representing spring force vs. deflection is not ideally linear, but rather, increases non-linearly with increasing deflections, such that it approaches a maximum value of deflection tangentially, beyond which value the elastomer becomes substantially incompressible, regardless of the level of force applied to it. At this point, the elastomer is said to have "bottomed out," and is therefore incapable of absorbing any more shock energy.

Thus, while conventional footwear employing elastomeric mid-soles are capable of absorbing a moderate amount of impact energy during moderate athletic activities involving typical running and jumping, they are not capable of providing effective protection during activities involving extreme shocks and impacts, such as skateboarding and snowboarding, because of their tendency to bottom-out with higher levels of impact.

It is known that the addition of viscous damping can enhance the energy absorption of shock absorbers, even those with a "hardening" spring characteristic. In such systems, a larger portion of the kinetic energy applied to the mechanism is dissipated in the form of heat, rather than being temporarily stored in the mechanism in the form of potential, or "spring" energy. Unfortunately, elastomers typically have a relatively low inherent damping characteristic, and accordingly, some footwear designers have turned to the incorporation of viscous liquids, i.e., liquid "gels," in the soles of footwear to improve their damping characteristics.

Although liquid gels have relatively good damping characteristics, they have little or no inherent resiliency, or "rebound," and accordingly, must be considered "one-shot" impact absorption devices unless confined within an elastic container or envelope that restores them to their original, un-deflected shape. Thus, the container must have sufficient resiliency to restore both itself and the deflected gel to their original, un-deflected states when the deflecting force is removed from them. In general, the more viscous the liquid, the greater is its resistance to recovery. Accordingly, if a rapid rebound, or rate of recovery, of the liquid is necessary, as in the case of footwear, the effective spring rate of the container must be increased correspondingly, i.e., it must be made substantially stiffer, or harder, and this requirement may substantially offset the advantages of employing a liquid damping mechanism in the design.

However, it has been discovered that the effective damping characteristic, and hence, impact absorption capability, of an elastomeric mid-sole can be improved substantially without the attendant disadvantages of a liquid gel by the incorporation therein of at least one pad 130 (see FIG. 1) of a "solid gel," i.e., a quasi-elastomeric material having a resiliency or durometer approximating that of an elastomer, e.g., synthetic rubber, but a viscoelastic damping characteristic that is substantially greater than that of an elastomer. Solid gels can be manufactured by compounding dispersions of microscopic particles of certain polymers, e.g., polyvinyl chloride ("PVC"), silicon rubber, synthetic rubber, olefins or polyurethane, in certain liquid plasticizers, then molding the resulting liquid dispersion under heat until the polymer particles fuse together, thereby forming a sponge-like matrix containing "micro-channels" that are filled with the liquid plasticizer.

The resulting solid gel material formed thereby can have the resiliency of an elastomer, and consequently, when deformed, will quickly rebound, or return to its original, un-deflected configuration, without the need for its confinement in a resilient container. However, because of the reciprocative, frictional flow of the liquid plasticizer within the micro-channels of the polymer matrix during displacement and rebound of the material, the solid gel has a substantially higher viscoelastic damping characteristic than that of ordinary elastomers. This damping characteristic can be measured by a standard "resiliometer" test in which a steel ball of a particular mass is dropped onto the solid gel from a particular height. The damping characteristic is given by the height to which the ball rebounds, expressed as a percentage of the height from which the ball was originally dropped. Materials with a relatively low damping characteristic, such as certain synthetic rubbers, can have a rebound as high as 80–90%, whereas, materials with a relatively high damping characteristic, e.g., certain solid gels, can have a rebound characteristic as low as 10–15%.

Thus, in one preferred embodiment of the footwear of this invention, the solid gel pad 130 has a durometer, as measured on the Shore 00 scale, of not less than about 35, i.e., approximately that of a relatively soft EVA pad of equivalent thickness, and a rebound percentage, as measured on a Shore resiliometer, of not greater than about 35 percent. One such solid gel material is available commercially under the trademark "Gelpact" from Chase Ergonomics, Inc., of Albuquerque, N. Mex.

Figure 5A:
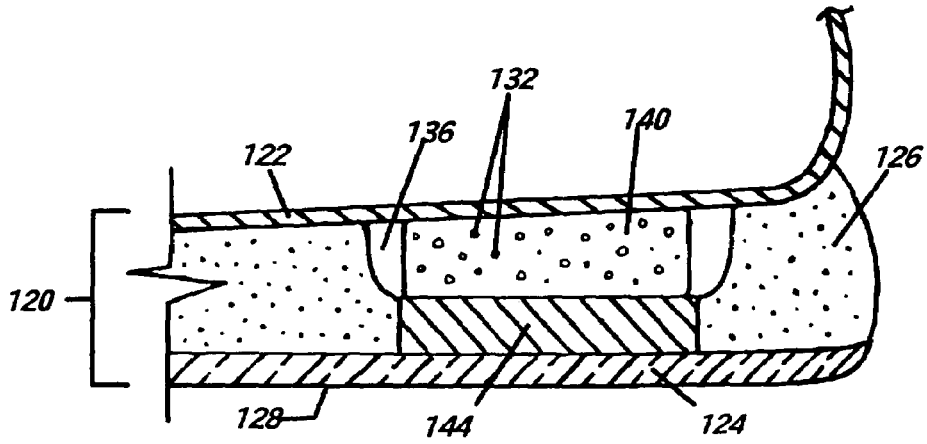
FIGS. 5A–5C are partial cross-sectional views of the sole of FIG. 3, as revealed by the section taken along the lines V—V therein through a heel portion thereof, showing the compressive displacements of the heel portion resulting from respectively low, moderate and extreme impacts of the wearer's foot against a supporting surface.
Figure 5B:
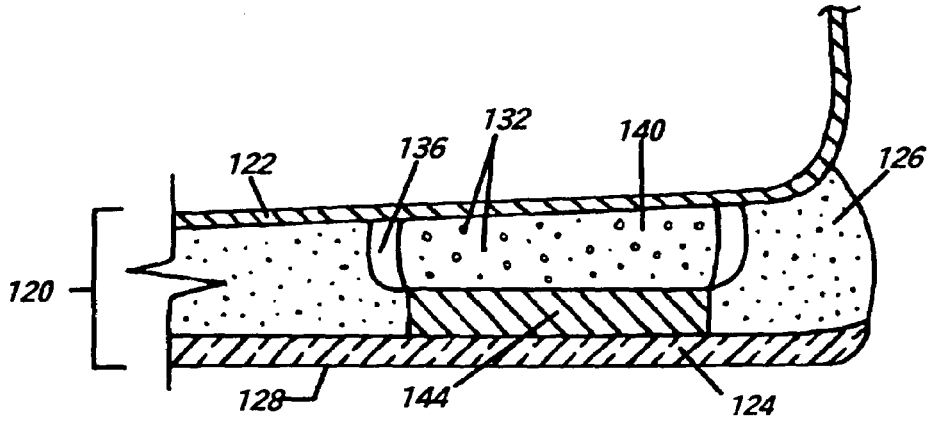
Figure 5C:
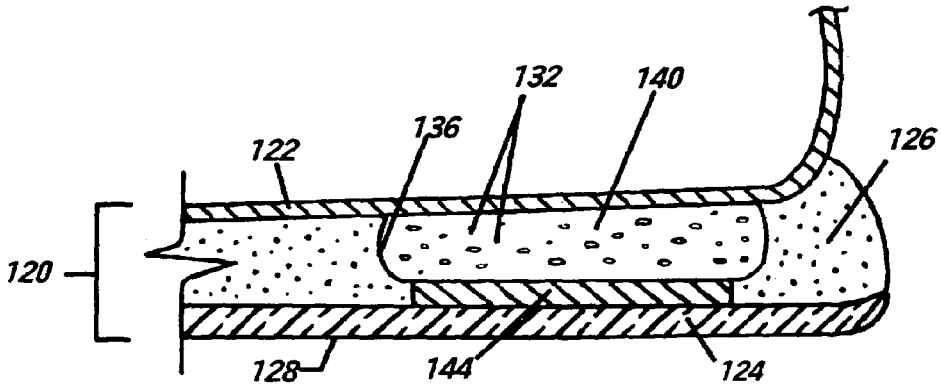

Additionally, the effective spring rate of an elastomeric pad is, for a given thickness of the material, a function of the area of the material in compression and its durometer, and, unlike liquid gels, the same is approximately true for the solid gel material. Thus, for a solid gel pad 130 of a given durometer, thickness and cross-sectional area, it is possible to reduce the effective spring rate of the pad by incorporating one or more gas-filled cells 132 (see FIGS. 5A–5C) into it. The cells may be closed to the ambient air, as illustrated in FIGS. 5A–5C, which can result in a pad that is only moderately softer than a solid pad, or open to the ambient air, e.g., in the form of tubular recesses (not illustrated) molded into the upper or lower surfaces of the pad, which can result in a pad that is substantially softer than a one without such cells.

Figure 7A:
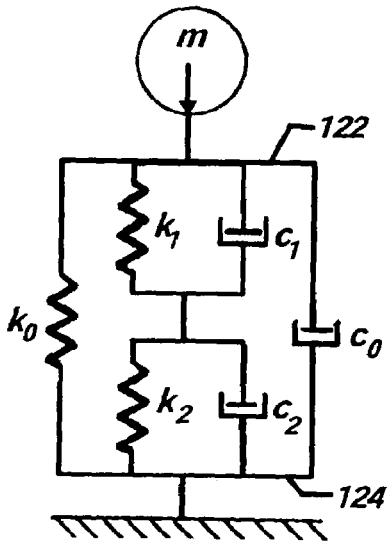
FIG. 7A is a spring-mass-dashpot analytical model of the sole of FIG. 3.

Returning to the first exemplary embodiment 100 illustrated in FIG. 1, the solid gel pad 130 may advantageously be combined with a second elastomeric pad 134 within the mid-sole 126 such that the two pads act in series combination with each other and in parallel combination with the mid-sole during conjoint compression thereof. This arrangement is illustrated schematically in the idealized, single-degree-of-freedom, spring-mass-dashpot analytical model of the mid-sole of FIG. 7A, wherein the respective spring rates and damping coefficients of the mid-sole, gel pad and second elastomeric pad are represented by $k_0$, $k_1$, $k_2$, and $c_0$, $c_1$, $c_2$, respectively, and wherein the mass of the wearer is represented by m and shown acting on the mid-sole in compression, i.e., in the direction of the arrow.

Figure 3:
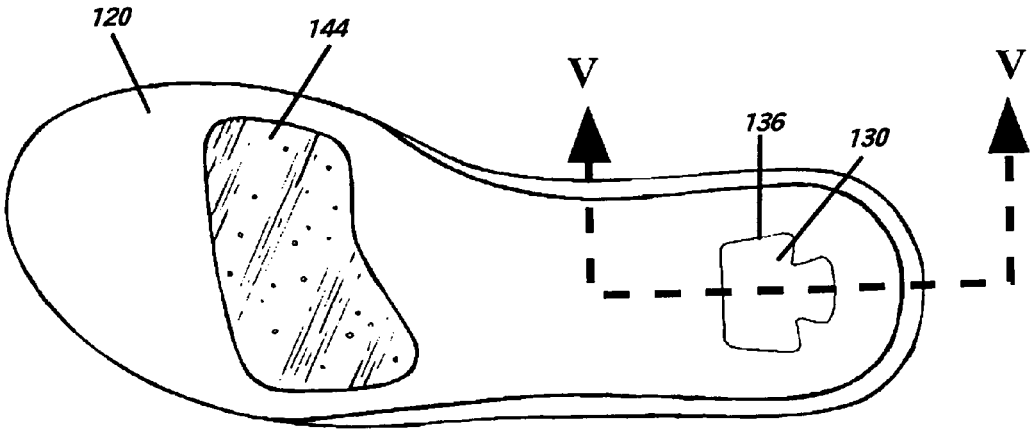
FIG. 3 is a top plan view of a sole portion of the footwear illustrated in FIG. 1.

More particularly, the two resilient pads 130 and 134 are preferably disposed in a recess 136 in the mid-sole 126, as illustrated in the plan view of FIG. 3, and the recess is preferably centered directly below the heel (i.e., the calcaneus) of the wearer's foot, where, in the idealized model, the center of the wearer's mass m is assumed to act during hard landings. In this arrangement, the insole 122 acts to "bridge" the contact of the wearer's heel evenly over the pads and the mid-sole. The second pad 134 is included to provide a degree of "adjustability" in the thickness and effective spring rate of the series combination with the solid gel pad 130. Thus, in the embodiment illustrated, the combined pads have a thickness and an effective, in-series spring rate of $k_s=k_1 \cdot k_2/(k_1+k_2)$, that are respectively about the same as the thickness and the spring rate of the mid-sole alone, i.e., the mid-sole without the recess and pad combination disposed therein. However, since the damping coefficients of the mid-sole and the second pad are essentially negligible, the combined pads have an effective damping coefficient ce that is effectively dominated by the damping coefficient $c_1$ of the gel pad, and hence, substantially greater than the damping coefficient of the mid-sole alone.

Figure 7B:
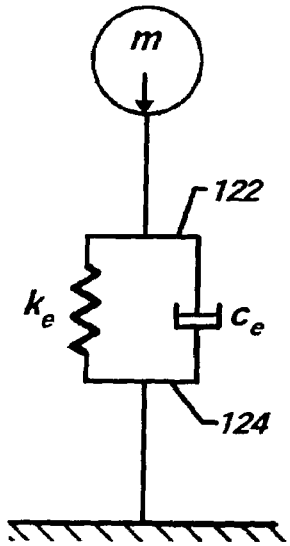
FIG. 7B is a spring-mass-dashpot analytical model equivalent to that illustrated in FIG. 7A.

Accordingly, the resulting equivalent spring-mass-dashpot analytical model of the mid-sole 126, illustrated in FIG. 7B, has an equivalent spring rate $k_e$ that is about the same as that of the mid-sole alone, whereas, the equivalent damping coefficient $c_e$ of the mid-sole is substantially greater than that of the mid-sole alone. This results in a shoe 100 with a sole 120 that provides good protection not only against low and moderate landing impacts, as respectively illustrated in the partial cross-sectional views of FIGS. 5A and 5B, in which its impact response is as good as or better than conventional athletic footwear, but also against extreme impacts, as illustrated in the partial cross-sectional view of FIG. 5C, that would cause the mid-sole of an ordinary athletic shoe to bottom-out, and thereby transmit a relatively greater portion of the landing force, or impact energy, to the wearer's foot.

The foregoing result has been confirmed by the comparison testing of a shoe 100 in accordance with the first exemplary embodiment described above and an identical shoe having a resilient EVA mid-sole without the solid gel and second resilient pads 130 and 134 recessed within it. Both shoes were tested in accordance with ASTM procedure F-1614, "Test Method for Shock Attenuating Properties of Material Systems for Athletic Footwear," in which cylindrical steel missiles of various masses, each instrumented with a load cell and having a flat, slightly radiused impacting surface corresponding to a wearer's foot, were dropped onto a selected target portions of the sole from selected heights to approximate foot landing impacts of selected glevels, and wherein the impact force (in Newtons) and associated penetration, or displacement (in mm) of the sole by the missiles were recorded and plotted for comparison purposes.

Figure 9:
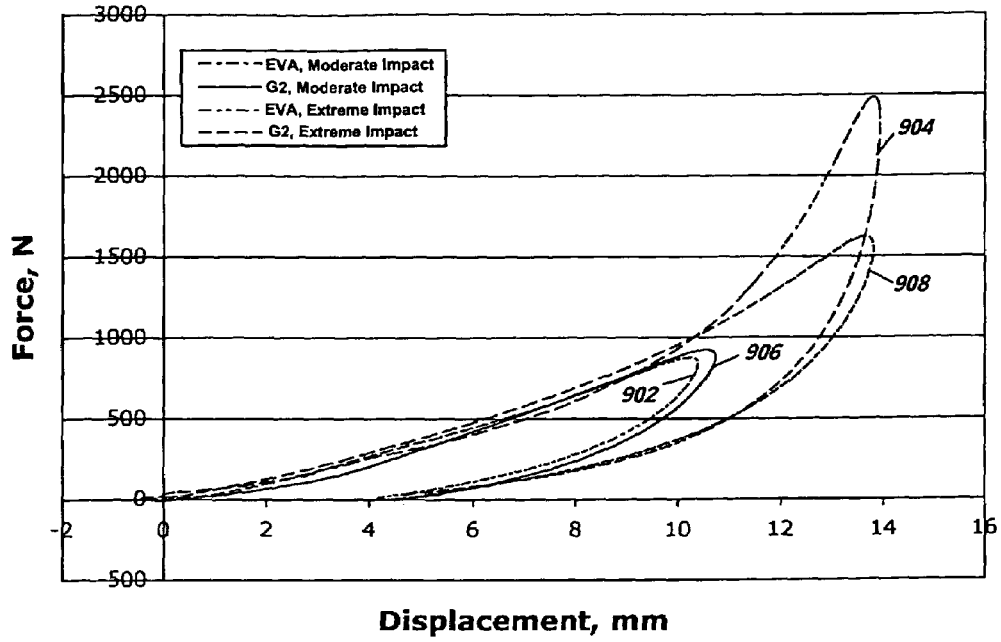
FIG. 9 is a graph of the respective compressive displacements of the sole of FIG. 3 and a conventional EVA sole in response to moderate and extreme landing impacts; and, FIG. 10 is a graph of the respective compressive displacements of the sole of FIG. 3 and a conventional EVA sole in response to moderate and extreme landing impacts.

The respective force-displacement ("F/D") curves of the conventional EVA mid-sole and the improved mid-sole 126 of the first embodiment 100 of the present invention in response to moderate and extreme landing impacts are plotted in FIG. 9, wherein the curves 902 and 904 represent the F/D profiles of the conventional shoe in response to moderate and extreme landing impacts, respectively, and wherein the curves 906 and 908 represent the F/D profiles of the improved shoe 100 in response to moderate and extreme landing impacts, respectively.

As may be seen in FIG. 9, the force-displacement curves of both shoes were generally hysteretic in nature, i.e., exhibited two values of displacement for a given level of force, the larger values constituting the upper portion of each curve and corresponding to the penetration of the ball into the respective soles during impact, and the smaller values constituting the lower potion of each curve and corresponding to the rebound of the ball from the respective soles after impact. The difference in the values is caused by the time "lag" between the rebound of the ball and the rebound of the sole material.

It may be further seen that, for moderate impacts, i.e., about 5 to 6 J (Joules) of impact energy, the conventional sole and the improved sole 120 both transmitted about the same peak impact forces to the foot, viz., about 850 N, whereas, in the case of extreme impacts, i.e., greater than 12 J of impact energy, the conventional sole transmitted a substantially greater peak impact force, viz., about 2500 N, to the foot, while the improved sole transmitted only about 1600 N to the foot, a reduction in the peak force transmitted of about 36%. It may also be noted that the F/D response curve 908 of the improved sole during extreme impacts is substantially "flatter," i.e., more linear, than the corresponding F/D curve 904 of the conventional EVA mid-sole, which exhibits a substantially "tangential," or hardening, spring rate characteristic of elastomeric materials.

Figure 2:
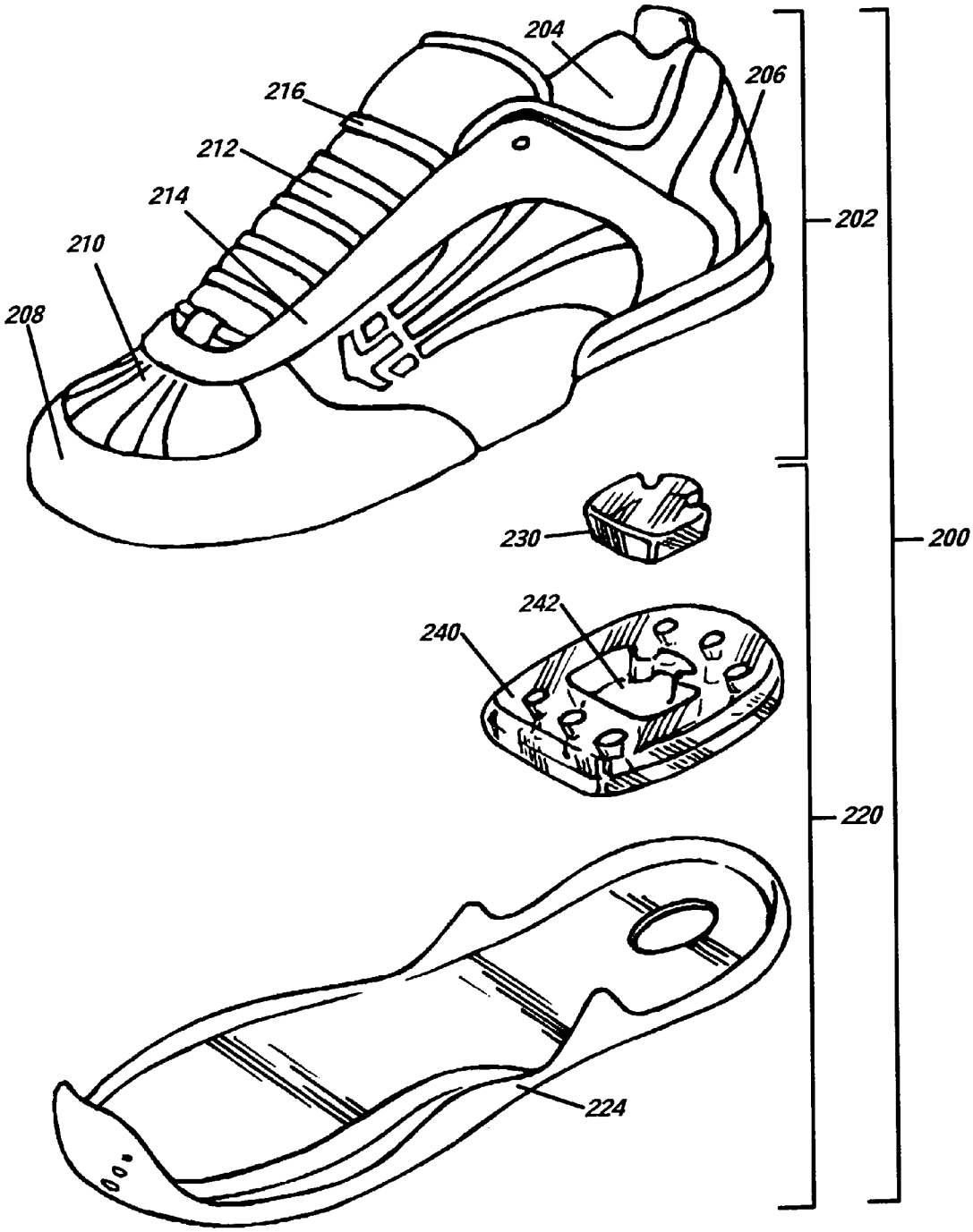
FIG. 2 is an exploded view of footwear providing enhanced protection against extreme landing impacts in accordance with a second exemplary embodiment of the present invention.

A second exemplary embodiment of a shoe 200 in accordance with the present invention is illustrated in the exploded view of FIG. 2, wherein elements identical or similar to those in the first embodiment 100 are indicated by similar reference numbers, but to which 100 has been added. Like the first embodiment, the second embodiment comprises two portions, an upper 202 and a sole 220. The upper of the second embodiment is substantially similar to that of the first embodiment, and accordingly, further description of its constituent parts is omitted for brevity.

The sole 220 of the second exemplary embodiment of the shoe 200 also comprises some elements that are functionally similar to those of the sole 120 of the first embodiment above, including an insole 222 (see FIGS. 6A–6B), an outsole 224 and an elastomeric mid-sole 226 (see FIGS. 4, 6A–6B; omitted for clarity in FIG. 2) comprising a heel portion and a forefoot portion. However, the sole of the second embodiment differs from that of the first in that it comprises a gas-filled cushion 240 that replaces, or occupies substantially all, of the heel portion of the mid-sole, as illustrated in the plan view of FIG. 4. In the exemplary embodiment illustrated, the cushion includes toroidal walls that define a generally central recess 242 in the cushion, and respective upper and lower surfaces that are generally flush with the respective upper and lower surfaces of the mid-sole 226.

Gas cushions, or springs which employ a gas, such as air, as their resilient element, can compete favorably with elastomeric and metal springs, especially in footwear, because the energy storage capacity of the gas is, on a weight basis, much greater than that of, e.g., an elastomer or a metal. However, gas springs also exhibit some of the drawbacks discussed above regarding liquid gels, i.e., the gas has little or no inherent resiliency unless it is confined in a resilient container, and typically, in a compressed state, i.e., at a pressure greater than atmospheric pressure. Also, like most elastomers, gas cushions exhibit little or no viscous damping, and also have substantially non-linear F/D characteristics, i.e., they harden substantially with increasing loading.

It has been discovered that the non-linear F/D characteristics of a gas cushion can be minimized to a certain extent by minimizing the variation in the area of the spring with deflection, and that its damping characteristics can be improved significantly by combining a solid gel pad 230 acting in combination with it, at least during extreme impacts, wherein the deflection of the spring is greater, as in the case of the first embodiment of shoe 100 described above. Thus, in the preferred embodiment of FIGS. 2 and 6A–6B, the configuration of the gas cushion 240 is that of an oblate toroid, i.e., a flattened doughnut, and the solid gel pad is disposed in the recess 242 of the cushion such that its upper surface is recessed a selected distance h below the upper surface of the cushion. The cushion is filled with air or another gas at a pressure greater than atmospheric pressure, preferably from between about 0–6 psig, or alternatively, the pressure of the gas can be adjusted to give the cushion a spring rate in compression that is about the same as that of the mid-sole 226 alone.

Figure 6A:
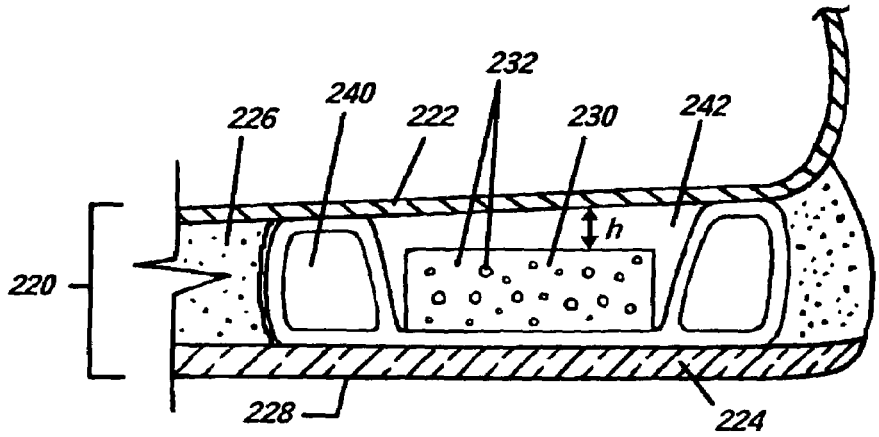
FIGS. 6A–6C are partial cross-sectional views of the sole portion of FIG. 4, as revealed by the section taken along the lines VI—VI therein through a heel portion thereof, and showing the compressive displacements of the heel portion resulting from respectively low, moderate and extreme impacts of the wearer's foot against a supporting surface.
Figure 6B:
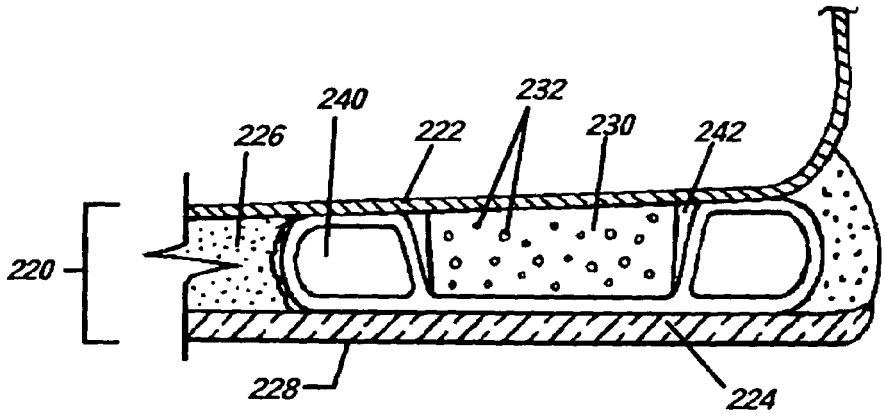
Figure 8A:
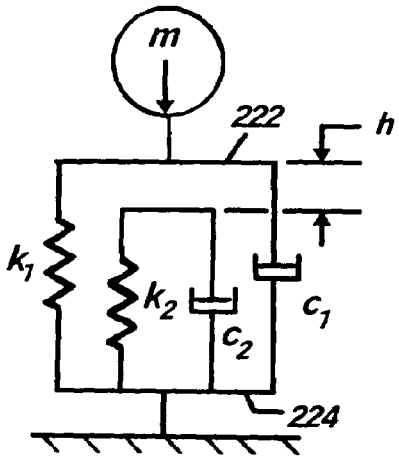
FIG. 8A is a spring-mass-dashpot analytical model of the sole portion of FIG. 4.
Figure 8B:
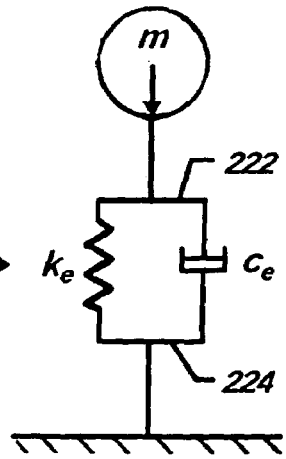
FIG. 8B is a spring-mass-dashpot analytical model equivalent to that illustrated in FIG. 8A.

The spring-mass-dashpot analytical model of this arrangement is illustrated in FIG. 8A, wherein the respective spring rates and damping coefficients of the gas cushion 240 and the gel pad 230 are represented by $k_1$, $k_2$ and $c_1$, $c_2$, respectively. It may be seen that, in this arrangement, the gas cushion 240 acts independently of both the mid-sole 226 and the solid gel pad 230 for small to moderate deflections, i.e., deflections less than h, of the cushion, corresponding to small to moderate landing impacts of the foot, as illustrated in FIGS. 6A and 6B, respectively. Thus, for impacts at this lower level, the resulting equivalent spring-mass-dashpot analytical model of the mid-sole 226, illustrated in FIG. 8B, has an equivalent spring rate $k_e$ and equivalent damping coefficient $c_e$ that are respectively about the same as the spring rate $k_1$ and the damping coefficient $c_1$ of the air cushion alone.

Figure 6C:
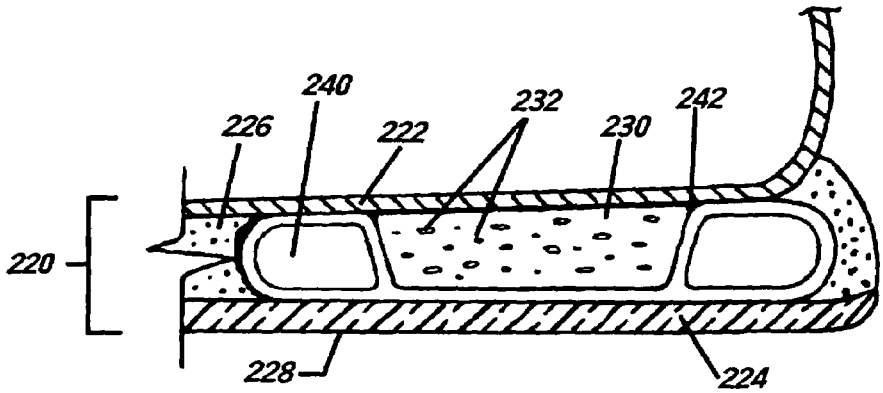

However, for extreme landing impacts, i.e., those that result in deflections of the gas cushion 240 that are greater than h, as illustrated in FIG. 6C, the gas cushion and the solid gel pad 230 act in parallel combination with each other, such that the effective spring rate $k_e$ of the mid-sole 226 is equal the sum of the respective spring rates of the gas cushion and the gel pad 230, $k_1+k_2$, and even though the damping coefficient $c_1$ of the gas cushion itself is relatively negligible, the effective damping coefficient ce of the combination is nevertheless substantially greater than the mid-sole alone, and is essentially that of the gel pad alone, i.e., $c_2$.

The foregoing arrangement of impact-absorption elements results in a shoe 200 with a sole 220 that, like the improved sole 120 of the first embodiment above, provides good protection not only against low and moderate landing impacts, but against extreme impacts, as well. This has been confirmed by the comparison testing of a shoe 200 in accordance with the second embodiment and an identical shoe having only a conventional resilient EVA mid-sole without the gas cushion 240 and solid gel pad 230 disposed within it. As with the first embodiment of shoe 100 above, both shoes were tested and evaluated in accordance with the ASTM test procedure F-1614 described above.

Figure 10:
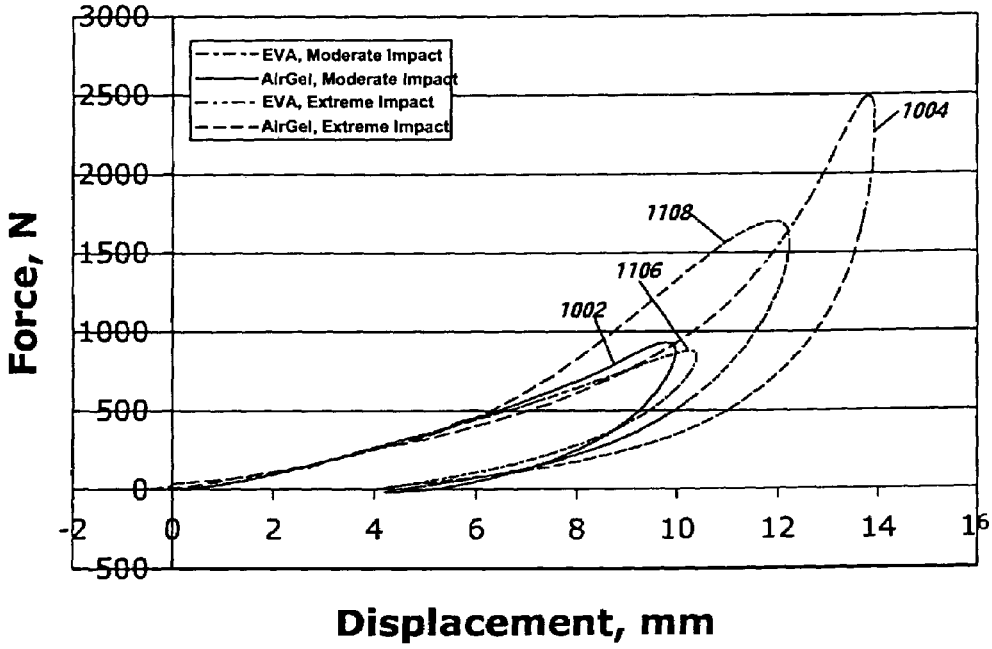

The respective force-displacement ("F/D") curves of the conventional EVA mid-sole and the novel mid-sole 226 of the second embodiment of shoe 200 of the present invention in response to moderate and extreme landing impacts are plotted in FIG. 10, wherein the curves 1002 and 1004 represent the F/D profiles of the conventional shoe in response to moderate and extreme landing impacts, respectively, and wherein the curves 1006 and 1008 represent the F/D profiles of the improved shoe 200 in response to moderate and extreme landing impacts, respectively.

As may be seen in FIG. 10, for moderate impacts, i.e., impact energies of 5–6 J, the conventional sole and the improved sole 220 both transmitted about the same peak impact forces to the foot, viz., about 875 N and 900 N, respectively, whereas, in the case of extreme impacts, i.e., impact energies of greater than 12 J, the conventional sole transmitted a substantially greater peak impact force to the foot, viz., about 2500 N, while the improved sole transmitted only about 1700 N to the foot, a reduction in the peak force transmitted of about 32%.

Figure 4:
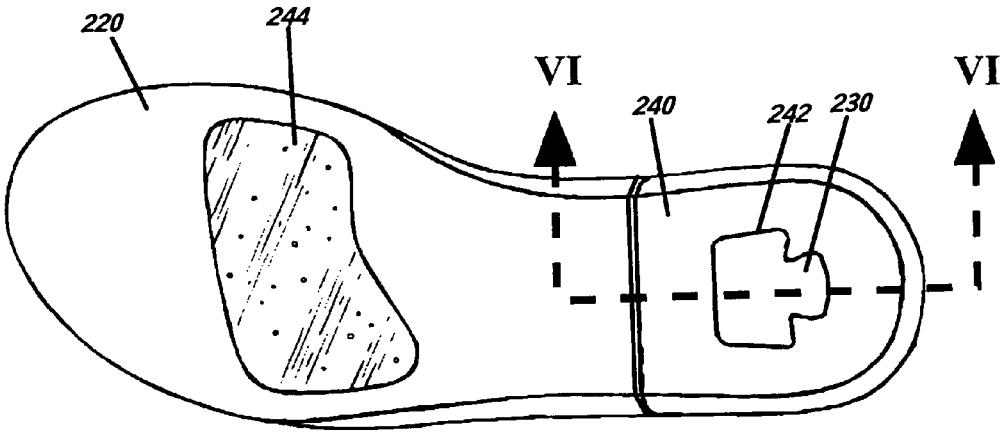
FIG. 4 is a top plan view of a sole portion of the footwear illustrated in FIG. 2.

As will by now be evident to those of skill in this art, many modifications and variations are possible in the materials, methods and configurations of the footwear of the present invention without departing from its spirit and scope. For example, it is possible to achieve additional impact protection to the foot of the wearer by incorporating a recessed elastomeric pad 144 or 244 with a relatively high damping, preferably a pad of a solid gel, in the forefoot portion of the mid-sole and below the ball of the wearer's foot in either embodiment of shoe 100 or 200, as illustrated in FIGS. 3 and 4. In light of the foregoing, the scope of the present invention should not be limited by that of the particular embodiments described and illustrated herein, as these are merely exemplary in nature. Rather, the scope of the present invention should be commensurate with that of the claims appended hereafter and the functional equivalents thereof.

What is claimed is:

1. Footwear providing enhanced protection against extreme landing impacts to the feet of a wearer, comprising:

an elastomeric mid-sole having a spring rate, a heel portion and a forefoot portion;

a gas-filled cushion occupying substantially all of the heel portion of the mid-sole, the cushion having toroidal walls, a generally central recess, and respective upper and lower surfaces that are generally flush with respective upper and lower surfaces of the mid-sole; and, a generally flat elastomeric pad disposed in the recess of the cushion and having an upper surface that is recessed a selected distance below the upper surface of the cushion.

2. The footwear of claim 1, wherein the cushion is filled with air at a pressure of from between about 0–6 psig.

3. The footwear of claim 1, wherein the cushion has a spring rate in compression that is about the same as that of the mid-sole.

4. The footwear of claim 1, wherein the elastomeric pad comprises a solid gel having a Shore 00 scale durometer of not less than about 35, and a Shore rebound of not greater than about 35 percent.

5. The footwear of claim 1, wherein the elastomeric pad comprises polyvinyl chloride, polyurethane or silicon rubber.

6. The footwear of claim 1, wherein the elastomeric pad incorporates a plurality of gas-filled cells.

7. The footwear of claim 6, wherein:

substantially all of the cells are open to the atmosphere, substantially all of the cells are closed to the atmosphere, or some of the cells are open to the atmosphere and some of the cells are closed to the atmosphere.

8. The footwear of claim 1, further comprising an elastomeric pad recessed in the forefoot portion of the mid-sole below the ball of the wearer's foot.

9. The footwear of claim 8, wherein the elastomeric pad comprises a solid gel having a Shore 00 scale durometer of not less than about 35, and Shore rebound of not greater than about 35 percent.

10. A method for providing enhanced protection against extreme landing impacts to the foot of a wearer of footwear, the method comprising:

providing a doughnut-shaped, gas-filled cushion in a heel portion of the footwear, the cushion having a generally central opening disposed below the calcaneus of the wearer's foot; and, positioning a first, generally flat elastomeric pad in the opening of the cushion such that the cushion reacts substantially independently of the pad in response to relatively small to moderate compressions thereof by the wearer's foot, and reacts in parallel combination with the pad in response to relatively large compressions thereof by the wearer's foot.

11. The method of claim 10, wherein positioning the first pad comprises recessing an upper surface of the pad a selected distance below an upper surface of the cushion.

12. The method of claim 10, further comprising positioning a second elastomeric pad in a forefoot portion of the footwear and below the ball of the wearer's foot.

13. The method of claim 10, wherein the first pad comprises a solid gel having a Shore 00 scale durometer of not less than about 35, and a Shore rebound of not greater than about 35 percent.

14. The method of claim 12, wherein the second pad comprises a solid gel having a Shore 00 scale durometer of not less than about 35, and a Shore rebound of not greater than about 35 percent.

15. Footwear providing enhanced protection against extreme landing impacts to the feet of a wearer, comprising:

an upper portion defining a compliant enclosure for at least an upper portion of the wearer's foot; and, a sole portion attached to a lower margin of the upper portion, the sole portion including:

an outsole comprising a strong, resilient, wear-resistant material and having an upper surface defining a support surface for the sole of the wearer's foot;

an elastomeric mid-sole disposed on the upper surface of the outsole, the mid-sole having a first damping coefficient, a heel portion and a forefoot portion;

a resilient, doughnut-shaped heel cushion occupying substantially all of the heel portion of the mid-sole, the heel cushion having a generally central opening, a second damping coefficient, and respective upper and lower surfaces that are generally flush with respective upper and lower surfaces of the mid-sole; and, a first, generally flat pad of solid gel disposed in the opening of the cushion such that an upper surface of the pad is recessed a selected distance below the upper surface of the cushion, the first pad having a third damping coefficient that is substantially greater than either the first or the second damping coefficients.

16. The footwear of claim 15, wherein the heel cushion comprises a pressurized gas cushion.

17. The footwear of claim 15, wherein the first solid gel pad has a Shore 00 scale durometer of not less than about 35, and a Shore rebound of not greater than about 35 percent.

18. The footwear of claim 15, further comprising a second pad of solid gel recessed in the forefoot portion of the mid-sole below the ball of the wearer's foot.

* * * * *